United States Patent [19]

Smets et al.

[11] Patent Number: 4,506,126

[45] Date of Patent: Mar. 19, 1985

[54] METHOD AND APPARATUS FOR BONDING GLAZING PANELS

[75] Inventors: Jacques Smets, Brussels; Michel Laurent, Nivelles, both of Belgium

[73] Assignee: Glaverbel, Brussels, Belgium

[21] Appl. No.: 498,573

[22] Filed: May 26, 1983

[30] Foreign Application Priority Data

May 28, 1982 [GB] United Kingdom ..... 8215716

[51] Int. Cl.[3] ..... H05B 6/64

[52] U.S. Cl. ..... 219/10.53; 219/10.41; 219/10.77; 219/10.49 R

[58] Field of Search ..... 219/10.77, 10.49 R, 219/10.53, 10.57, 10.79, 10.41, 10.43, 10.75

[56] References Cited

U.S. PATENT DOCUMENTS

| | | | |
|---|---|---|---|
| 4,289,946 | 9/1981 | Yarwood et al. | 219/10.77 |
| 4,307,276 | 12/1981 | Kurata et al. | 219/10.41 |
| 4,309,586 | 1/1982 | Ishibashi | 219/10.77 |

FOREIGN PATENT DOCUMENTS

| | | |
|---|---|---|
| 831166 | 3/1960 | United Kingdom . |
| 1227943 | 4/1971 | United Kingdom . |
| 1307843 | 2/1973 | United Kingdom . |
| 1506282 | 4/1978 | United Kingdom . |
| 1589878 | 5/1981 | United Kingdom . |

*Primary Examiner*—Roy N. Envall, Jr.
*Assistant Examiner*—Marvin M. Lateef
*Attorney, Agent, or Firm*—Spencer & Frank

[57] ABSTRACT

In a method of manufacturing a glazing panel comprising sheets which are joined together along the margin of the panel using heat-activatable bonding medium (e.g. solder) which is electrically conductive and/or in contact with electrically conductive material and which is activated in situ by induction heating, the induction heating is performed using an inductor 65 powered by an aperiodic generator 57 whose power output setting is determined in dependence on the instantaneous resonant frequency of the inductor circuit as influenced by the load.

26 Claims, 8 Drawing Figures

METHOD AND APPARATUS FOR BONDING GLAZING PANELS

BACKGROUND OF THE INVENTION

The present invention relates to a method of manufacturing a glazing panel comprising sheets which are joined together along the margin of the panel using heat-activatable bonding medium which is electrically conductive and/or in contact with electrically conductive material and which is activated in situ by induction heating.

Such a method is applicable for example in the manufacture of hollow glazing panels, the sheets being bonded together by intervening spacing means. The spacing means may for example comprise a metal spacer rail or rails which is or are bonded to metallised margins of the sheets by solder which is melted in situ. As an alternative a heat-activatable adhesive composition can be used for bonding the sheets to a spacer of metal, glass or other material. As a further alternative the spacing means may be constituted by the heat-activatable bonding material itself.

Various proposals to join assembled components of a hollow glazing panel by using an induction heating step are described in literature, e.g. in British patent specifications Nos. 831 166, 1 307 843 and 1 506 282. Most of the prior proposals are of a general nature in the sense that they refer to induction heating as one of the possible ways in which jointing material can be heated in situ, but give at best very little information concerning the form of induction heating apparatus and the procedures which should be used.

In the above mentioned patent specifications: British Pat. No. 831 166 simply states that the assembled components, in that case glass panes and an intervening copper spacer strip, can be placed on a conveyor, moved into a tunnel oven wherein the work assembly is raised to 500° C. and then moved past an alternating magnetic field whereby the temperature of the spacer strip is raised by the induced current sufficiently to fuse the edges of the ring to the glass panes. In this method the heating is sufficient to melt the portions of glass which are in contact with the metal ring so that no separate bonding medium is needed, but the specification does indicate that the metal can be coated with a layer of a bonding agent such as easy-melting powdered glass or borax, in order to improve the wetting of the metal by the molten glass.

British patent specification No. 1 307 843 states that bonding medium for bonding the glass panels of a double glazing panel to an intervening metal spacer can be activated in situ by subjecting the assembly to an electrical heating treatment such as induction or resistance heating; but it does not give any information concerning suitable electrical heating apparatus or procedures.

British patent specification No. 1 506 282, which likewise refers to heating of the spacer rail or rails of a double glazing panel by means of an inductive eddy current, does include an outline of possible procedures. The specification says that the spacer rail or rails can be heated as a whole by means of inductive eddy current and goes on to state that satisfactory results may be achieved in many cases if a relatively large portion of the spacer rail is gradually heated by means of induced eddy currents to the temperature necessary for the joint sealing and the heat is thereafter allowed to progress successively and gradually along the spacer rail, e.g. by a slow successive relative displacement of the eddy current source with respect to the spacer rail in the longitudinal direction. In a specific embodiment use is made of high-frequency coils and a longitudinal portion of the spacer rail corresponding substantially to the diameter of the high-frequency field is slowly heated to the jointing temperature before the panel assembly is displaced to conduct its adjacent edge areas successively through such field.

When assessing the suitability of an inductive heating method for use in the production of panel joints under industrial mass production conditions, various factors need to be considered. Most important of course is the quality of the panel joints and the reliability with which a given joint standard can be reproduced. The panel joints must not only have a certain minimum strength to withstand forces imposed on the panel in use, but they should be of uniform quality around the panel.

The formation of joints satisfying a given quality standard is dependent on the generation of an appropriate amount of heat in the heat-activatable bonding medium and usually both the temperature to which the bonding medium is raised and the heating time must be within certain limits. For example, when manufacturing glazing panels in which metallised margins of the glass sheets are soldered to an intervening metal spacer, it is important for the solder to be sufficiently heated to become molten to give good wetting of the metallised sheet margins and the spacer and to produce well-formed solder beads but the molten state must not persist for more than a very short time otherwise there would be a risk of corroding the contacting metal, particularly the said metallised sheet margins.

The heating effect of an induction heating apparatus operated at a given inductor input power depends on a number of factors including the composition of the work to be heated and the dimensions thereof, and also to its spacing from the inductor. An appreciable amount of experimentation may be required to establish appropriate settings of the apparatus for particular circumstances. The control of the heating apparatus for jointing different panel assemblies, and particularly for jointing panel assemblies of different dimensions, e.g. different thickness and/or length and breadth dimensions, therefore involves considerable difficulty.

SUMMARY OF THE INVENTION

It is an object of the invention to provide an inductive heating method which by virtue of its manner of adjustment is very suitable for use in an industrial panel production line, and for use in manufacturing panels of different specifications.

According to the present invention there is provided a method of manufacturing a glazing panel comprising sheets which are joined together along the margin of the panel using heat-activatable bonding medium which is electrically conductive and/or in contact with electrically conducting material and which is activated in situ by induction heating, characterised in that the induction heating is performed using an inductor powered by an aperiodic generator whose power output setting is determined in dependence on the instantaneous resonant frequency of the inductor circuit as influenced by the load.

In this method control of the heating effect is simplified because the resonant frequency automatically adjusts to the impedance of the load and this is itself indicative of the heating energy requirements of the work and leads to the use of the appropriate energy for forming the bond.

Generator output power values related to one or more heating times and suitable for forming panel joints of given specifications in panel assemblies of different dimensions can be determined by tests and recorded as reference for control purposes when induction heating apparatus is employed in the successive manufacture of panels of different types and/or sizes. Once the resonant frequency of the inductor circuit has been determined, the appropriate corresponding generator output setting required for effecting the jointing of the panel components in a standard heating time, or in any of a number of selectable heating times, can readily be determined from the recorded information.

In preferred embodiments of the invention, the appropriate combination of generator output power and heating time values is determined by a computer to which signals indicative of the resonant frequency are fed and in which is stored information pertaining to output power settings appropriate to different resonant frequencies and to a particular heating time or to different heating times.

This is a quick and easy way of regulating the power used for bonding panels in series production, for example series production of panels of differing dimensions.

In practice, in the series production of glazing panels it is desirable that the panels should move along the production line according to a fixed schedule, and this implies a fixed heating time. The computer stores information relating to the optimum power output for a range of frequencies for achieving a good quality joint which is derived from practical tests, and the primary function of the computer is thus to control the generator output power in sole dependence on the resonant frequency of the inductor circuit as influenced by the load.

Of course, in some cases the heating time is variable and may be pre-adjusted to suit the work in hand. A timing circuit can be provided between the generator and the inductor.

Advantageously, said generator is switched on at a first power output for an initial period during which said resonant frequency is monitored, whereafter the power output of the generator is increased to a setting appropriate to the monitored resonant frequency. This promotes economic use of power. It is especially preferred that such initial power output should be the minimum power output at which the particular generator being used operates.

Preferably the load circuit includes one or more inductors which is or are entirely or partly displaceable for varying the work/inductor spacing and the method of the invention is employed in the successive manufacture of panels of different sizes with appropriate adjustment of the inductors to suit such different sizes.

The inductor may be constituted by one or more coils, but preferably the inductor is in the form of a loop or loops formed by a conductor or conductors so disposed in relation to the marginal course of the joint(s) to be formed that the bonding medium is heated simultaneously at all positions along such joint(s). The performance of the invention in that manner has the advantages that the peripheral jointing of panels can be effected very rapidly and by means of very simple apparatus, there being no need for any relative displacement of the inductor along the course of the joint(s) during heating.

In particularly recommended embodiments of the invention the inductor is in the form of a loop as above referred to and such loop is formed by a conductor or conductors of tubular bar or of rod form. The eddy current field generated by the loop is very effectively distributed in relation to the work so that the generated heat-power consumption ratio is quite high. The best results are attained when the loop-forming conductor(s) is or are of rectangular cross-section.

In the manufacture of a polygonal panel, use can be made of an inductor loop of similar shape comprising straight conductors forming the sides of the loop polygon. The inductor loop can easily be held in the required working position at a heating station, e.g. by supporting means at the ends of the conductor or conductors and/or by a small number of supports located between those ends.

The invention can be employed in the manufacture of panels in which the sheets are bonded to an intervening spacer strip or strips, e.g. a metal spacer rail or rails. A single spacer rail can be used if it is bent to form a frame of the same shape as the panel. Alternatively, a plurality of spacer rails can be used in end to end relationship. For example, in the manufacture of a polygonal panel there may be a straight spacer rail extending along each margin of the polygon. Such spacer rails can be endwise connected together e.g. by corner pieces. When using a metal spacer rail or rails it is not necessary for the bonding medium to be electrically conductive.

In the manufacture of panels with one or more inter-sheet spacer strips the induction heating method according to the invention can be employed for bonding both sheets to the spacer(s) or for bonding only one of the sheets thereto the other sheet being bonded to the spacer(s) by some other method. When the invention is employed for bonding both sheets to a spacer or spacers, both sheets can be bonded to the spacer(s) simultaneously, using the one induction heating step, or they can be bonded to the spacer(s) in successive operations.

The invention can also be employed in the manufacture of panels in which the sheets are directly bonded together by the heat-activatable bonding medium. If the panel is one wherein the sheets are joined in spaced relationship, this means in effect that the bonding medium, which must be formed from or in contact with conductive material, serves as inter-sheet spacing means.

Preferably the inductor is in the form of a loop as hereinbefore referred to and is arranged so that (as viewed perpendicularly to the plane of the loop, by which is meant the plane containing the longitudinal axis of the inductor) the path of the inductor is at a substantially uniform spacing from the course of the joint(s) to be formed. This condition is usually most favourable for efficient use of the power source.

The size of the gap between the conductor loop and the work has an effect on the power consumption for bonding any given panel.

Preferably the gap between the joint or joints to be formed and the conductors at all points along the course of the joint or joints is less than the height of the conductors composing the loop. Alternatively, or in addition, it is preferred that the said gap between the joint or joints to be formed and the conductors of the loop is less than 30 mm.

In the most preferred embodiments of the invention, the electrically conductive material which constitutes or is in contact with the bonding medium forms a continuous conductive path around the margin of the panel. This gives a much better power transfer from the inductor loop since the loop and conductive material then act as a transformer and the conductive material is heated by circulating current.

In the most preferred embodiments of the invention, the method is used for simultaneously joining two sheets to inter-sheet spacing means disposed along the margin of the panel and for this purpose the inductor loop is arranged so that the plane of the loop is located substantially symmetrically between said sheets. Such embodiments have the important advantage that uniform bonding of both sheets can be effected very rapidly with good coupling between the loop and conductive material at the margin of each sheet.

Advantageously, the loop has a said symmetrical location in relation to the thickness of the work and the loop is composed of a conductor or conductors whose dimension (measured parallel with the thickness dimension of the work) is less than the inter-sheet spacing. It has been found that under these circumstances the power consumption for a given heating effect along the courses of the joints is less than when using a conductor or conductors whose said dimension is equal to or greater than said spacing.

Preferably the inductor is in the form of a loop comprising a plurality of conductors which are relatively displaceable for varying the size of the loop. An adjustable loop has the advantage that when manufacturing panels of a given size, the gap between the inductor and the course of the joint to be formed can be varied for varying the heating effect, e.g. to suit different heat-activatable bonding media. Another important advantage of an adjustable loop is that it can be used for heating bonding medium along the margin of a second panel different in size from the first panel, after adjusting the loop to suit that second panel. The loop/work spacing can in these circumstances be a constant for all panel sizes.

In optimum embodiments of the invention, use is made of a rectangular loop composed of conductors which are relatively displaceable so that each of the length and breadth dimensions of the rectangle can be varied.

In certain embodiments of the invention, the loop comprises a plurality of straight conductors and adjacent conductors are releasably or displaceably held in electrical contact with each other so that the conductors can be arranged in different relative positions for varying the dimensions or the dimensions and the shape of the loop. The conductor contacts may be of a kind permitting relative sliding movement of adjacent conductors. Alternatively releasable clamp connections can be employed.

In other embodiments of the invention, the loop comprises a plurality of straight conductors electrically connected in series by electrical conductors which are flexible so that they permit relative movement of said bars for varying the dimensions or the dimensions and the shape of the loop. Use can be made of such flexible connecting conductors instead of or in addition to releasable or displaceable contacts between the straight conductors as above referred to. When both types of connections are used the flexible conductors preserve the integrity of the loop in the event of failure or impairment of any of the said contacts.

Each of a plurality of tubular bar conductors forming the loop can be independently cooled by passage of fluid coolant along the tube.

The tubular bar conductor or conductors can be of any suitable material. In a particular embodiment use is made of tubular bars made of copper and plated with chromium. For making direct bar-to-bar contact it is very suitable to provide the bars or certain of the bars with attached contact portions, e.g. portions made of silver.

Any of a large variety of bonding media can be used in carrying out the invention.

In some embodiments of the invention, solder is used as the heat-activatable bonding medium. Preparatory to being soldered the glazing sheets should be metallised along the course of the joint to be formed. It is an advantageous procedure to apply solder along the metallised sheet margins preparatory to assembling the sheets, or the sheets and the separate spacer(s) if such is or are used, ready for the induction heating step. Such pre-applications of solder are recommended for promoting high joint quality. The use of solder joints has a particular application for example in the manufacture of double glazing units comprising sheets of glass connected to an intervening metal spacer rail at the margin of the unit.

In other methods according to the invention the bonding medium used is a heat-activatable adhesive. For example a type of hot-melt adhesive can be used, in which case the heat-activation is not more than a melting or softening operation and the bonding occurs on cooling of the adhesive. Suitable heat-sensitive adhesive compositions include polymeric compositions comprising a copolymer of ethylene with one or more hydroxy or epoxy lower aliphatic monoesters of acrylic or methacrylic acid, or with methacrylic acid and with a vinyl ester or an acrylic or methacrylic ester, as disclosed in United Kingdom patent specifications Nos. 1 227 943 and 1 307 843.

As further examples of types of heat-activatable bonding media which can be used in carrying out the invention are mentioned curable elastomeric compositions based on one or more butyl rubbers alone or in combination with other polymers such as ethylene/vinyl acetate copolymers or polyisobutylene, compositions based on one or more ethylene/propylene terpolymers particularly terpolymers of ethylene and propylene with a diene e.g. polyisobutylene, and compositions based on a butadiene/styrene copolymer or a butadiene/acrylonitrile copolymer. Useful information concerning these types of bonding media and cross-linking or vulcanisation agents for use in conjunction therewith is contained in United Kingdom patent specification No. 1 589 878.

Electrically conductive elements may be present in external surface contact with a heat-activatable adhesive composition as above referred to, along the course of the joint. For example in certain embodiments of the invention use is made of a metal spacer rail, and this strip is bonded to the panel sheets by said adhesive composition. Alternatively the panel sheets can be connected in spaced relation by means of a spacer strip or ribbon which is composed of a said adhesive composition, the margins of the sheets bearing electrically conductive coatings e.g. coatings of copper, in contact with such strip or ribbon.

In certain cases, electrically conductive material can be incorporated in the heat-activatable adhesive composition instead of or in addition to providing electrically conductive material in external surface contact therewith. For example, a vulcanisable rubber-type adhesive composition can incorporate particles of ferromagnetic material such as material selected from: iron, nickel, and cobalt and their alloys e.g. an Fe-Ni, Ni-Cr, Ni-Mn, Ni-Cr or Ni-Mn alloy, carbon copper, silver gold, aluminium, silicon and their alloys, and barium ferrite.

The inter-sheet bond between the sheets of the panel can be peripherally continuous, or it may be interrupted at one or more local zones. Such an interruption may for example be for the purpose of enabling gas to have access to the inter-sheet space.

The invention also extends to apparatus suitable for performing a method according to the invention as above defined. Apparatus according to the invention comprises induction heating means suitable for induction heating heat-activatable bonding medium present along the margin of an assembly of facing sheets to cause said sheets to be bonded together, characterised in that the apparatus comprises an inductor powered by an aperiodic generator, and means for automatically controlling the power output of the generator in dependence on the instantaneous resonant frequency of the inductor circuit as influenced by the load.

Preferably the apparatus includes a computer in which is stored information relating to generator output power settings appropriate to different resonant frequencies for a particular heating time or for different heating times, and said computer is connected to said inductor circuit and to said generator for automatically regulating the power output of the generator.

In preferred embdiments of the invention the inductor is in the form of a loop within which a panel assembly can be located so that the path of the loop surrounds the periphery of the assembly. The loop conductors can be supported by rigid members forming sides of a support frame. Most suitably such loop is of polygonal shape and comprises straight conductors forming the sides of the polygon.

Advantageously the said loop is adjustable in size. Suitable loop constructions for this purpose are as hereinbefore described and hereafter illustrated.

At least some of the loop conductors are preferably held in electrically conductive contact with each other releasably or displaceably to permit the size of the loop to be varied.

Advantageously, said conductors forming adjacent sides of a said polygon are movable in a direction oblique to themselves whereby the conductor(s) of each side is or are movable into or out of contact with the conductors of both adjacent sides of the polygon. This allows the area encompassed by the conductors to be increased for removal of a bonded glazing panel and insertion of a next assembly to be bonded. Where the loop is adjustable in size, this feature also has a beneficial effect in reducing wear at contacts between successive conductors during such adjustment.

It is preferred that at least one side of the inductor loop is bodily movable parallel with itself and relative to one or more other sides of the loop. At least one side of the inductor loop is preferably carried by a guided displaceable beam.

As has previously been stated, the loop is preferably formed by tubular bar conductors of rectangular section.

BRIEF DESCRIPTION OF THE DRAWING

Preferred embodiments of the invention will now be described in greater detail with reference to the accompanying diagrammatic drawings in which.

DESCRIPTION OF THE PREFERRED EMBODIMENTS

Figure 1:
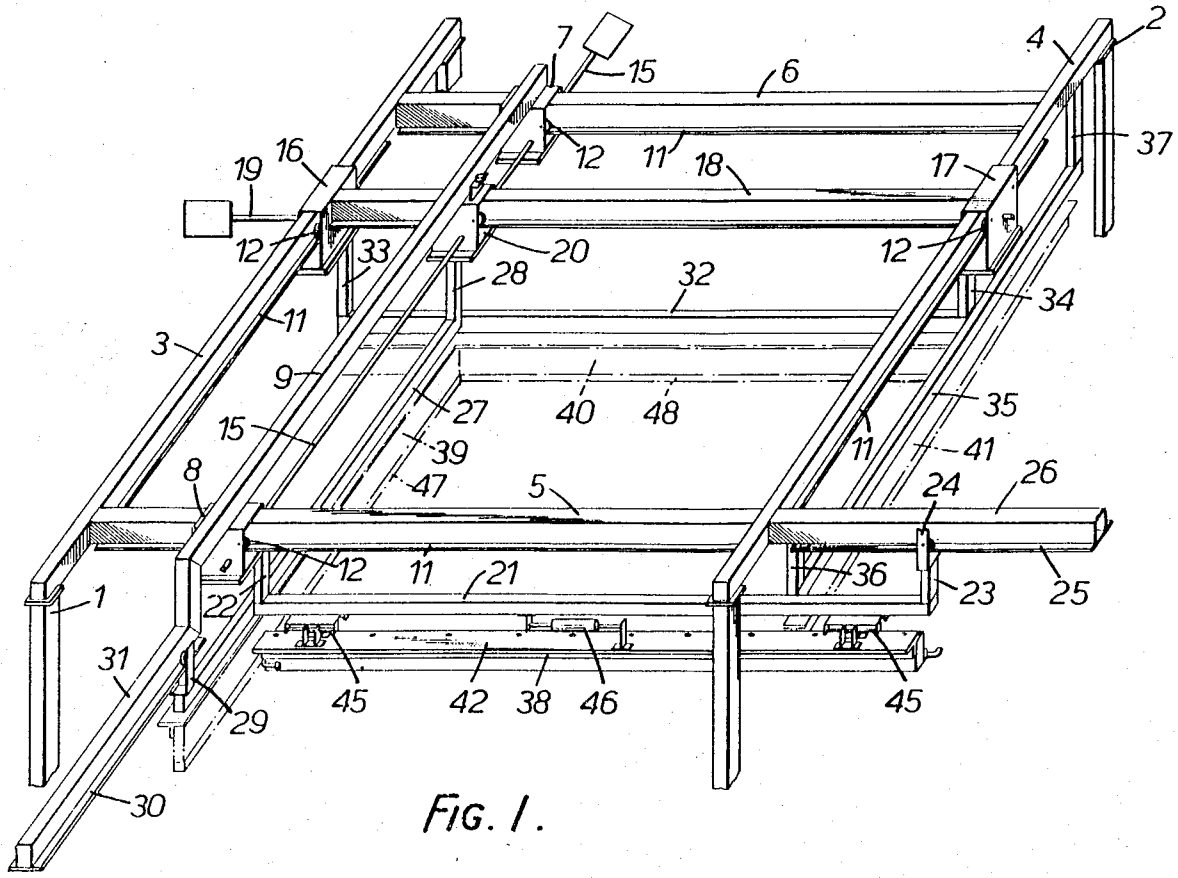
FIG. 1 is an isometric view of support means for an inductor loop for use in performing the invention.
Figure 5:
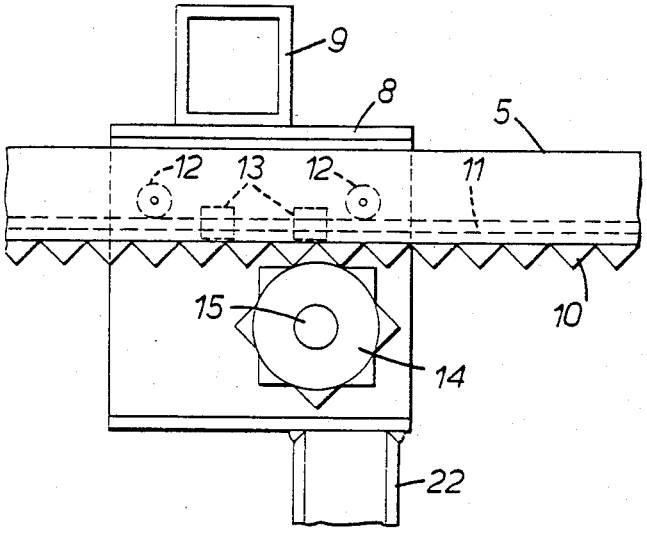
FIG. 5 illustrates how the loop support means and thus the loop may be adjusted in size.

In FIG. 1, a fixed frame is constituted by a pair of portals 1, 2 whose lintels 3, 4 are interconnected by horizontal fixed rails 5, 6. The rail 5 extends beyond the portal 2 for a purpose to be explained later. The fixed rails 5, 6 support carriages 7, 8 carrying rail 9 which is selectively movable along the fixed rails between the portal lintels remaining at all times parallel to those lintels. The carriage 8 is illustrated in greater detail in FIG. 5. In FIG. 5, the fixed rail 5 is provided with a rack 10 and a track flange 11 supporting rollers 12 attached to the carriage 8. The carriage 8 is provided with tracking guides 13 and is driven by a pinion 14 engaging the rack 10. The pinion is rotated by a drive rod 15 also shown in FIG. 1 and which drives a like pinion on the carriage 7 for synchronous movement of the two carriages.

Reverting now to FIG. 1, the fixed rail 6 is also provided with a track flange 11 for rollers such as 12 of its associated carriage 7.

The lintels 3, 4 also support carriages indicated at 16, 17, which support a second traveling rail 18 which is movable along the lintels 3, 4 between the fixed rails 5, 6 remaining at all times parallel to those fixed rails. The carriages 16, 17 are drivable by a rack and pinion arrangement similar to that illustrated in FIG. 5. Rollers and track flanges for the carriages 16, 17 are again indicated at 12 and 11 respectively in FIG. 1. A pinion drive rod for the carriages 16, 17 is indicated at 19 in FIG. 1.

The second travelling rail 18 moves beneath the first travelling rail 9, and they together define the position of a further carriage 20 which is slidable along both those rails.

A support beam 21 is carried beneath the fixed rail 5, one end being carried by a strut 22 fixed, e.g. welded, to the carriage 8, and the other end being carried by a strut 23 in turn carried by a trolley 24 movable along a track 25 carried by an extension 26 of the rail 5 which projects beyond the portal 2.

A second support beam 27 is carried beneath the travelling rail 9. One end of that second beam 27 is supported by a strut 28 fixed to the slidable carriage 20 and its other end depends from a trolley 29 movable along a track 30 carried by an extension 31 of the travelling rail 9.

A third support beam 32 is carried by struts 33, 34 respectively fixed to the carriages 16, 17 so that it is fixed beneath the second travelling rail 18, and a fourth support beam 35 is fixed by struts 36, 37 beneath the lintel 4 of the portal 2.

The support beams 21, 27, 32 and 35 are all carried at the same level, the first three being movable and the fourth, 35, being fixed.

Mounted beneath each of the support beams 21, 27, 32 and 35 are inductor loop conductor carriers respectively 38, 39, 40, 41 of which the last three are only indicated diagrammatically in dotted lines.

Figure 2:
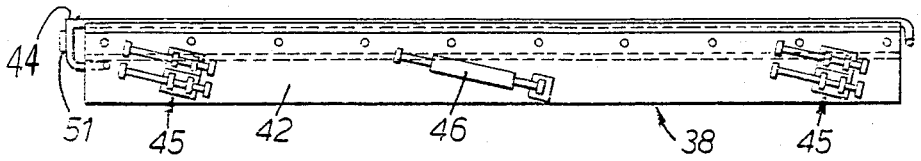
FIG. 2 is a plan view of a support for a conductor of the loop of FIG. 1.
Figure 3:
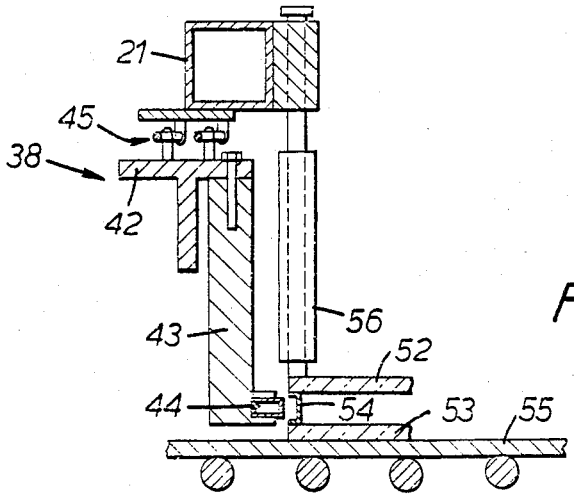
FIG. 3 is a sectional view showing the conductor of FIG. 2 positioned adjacent a panel to be bonded.

One of these inductor loop conductor carriers, 38, is shown in greater detail in FIGS. 2 and 3.

The carrier 38 comprises a T-bar 42 to which is bolted a holder 43 which holds a conductor 44 of an inductor loop.

In a modification, designed for example for the bonding of triple glazing units in a single operation, a conductor of a second loop (not shown) is carried by the holder 43 at a suitable vertical spacing from the conductor 44. The two inductor loops may be separately connected to a power supply, or they may be connected in series.

The T-bar 42 is mounted on two pairs of oblique guide rods 45 carried by the support beam 21 towards its ends. These guide rods 45 are parallel inter se but inclined to the axis of the beam 21 by about 15°, though this angle may be varied. A pneumatic ram 46 has one end attached to the T-bar 42 and its other end attached to the support beam 21. The ram 46 acts parallel to the guide rods 45.

Figure 4:
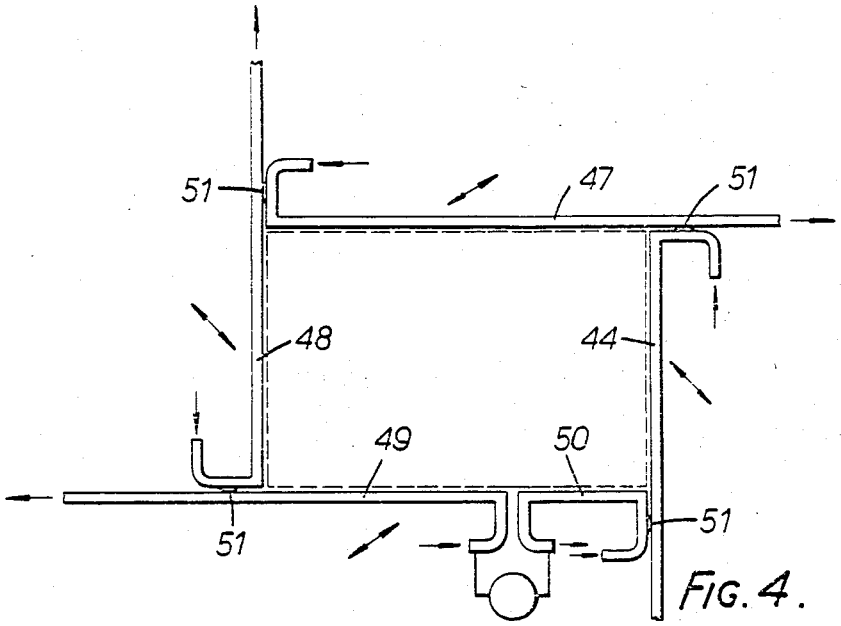
FIG. 4 is a diagrammatic representation in underplan view of the inductor loop.

Other conductor elements 47, 48, 49, 50 of the inductor loop (FIG. 4) are likewise mounted beneath the other support beams 27, 32 and 35. From FIG. 4 it will be noted that one side of the rectangular inductor loop is formed from two conductor elements, 49, 50. This is because it has been found more convenient to supply current to the loop at a position along one side rather than at a corner. It is also most convenient to supply current to that side of the loop which lies beneath the fixed support beam 35 (FIG. 1).

As shown in FIG. 3, the conductor element 44 is a rectangular tubular bar, for example of copper, so that cooling fluid can be caused to flow through it. The other conductor elements are of similar construction.

At each corner of the loop, a contact point 51, for example of silver, is attached to an end of a conductor element 44, 47, 48 and 50.

If it is desired to adjust the size of the inductor loop, pneumatic rams 46 are caused to extend so that contact points 51 are retracted from the conductor element against which they bear, and one or both of the pinion drive rods 15 and 19 is rotated as appropriate.

Rotation of drive rod 15 moves the first travelling rail 9, and thus the second support beam 27 and conductor element 47, parallel with itself and also moves the first support beam 21, and thus conductor element 44, along its axis.

Rotation of drive rod 19 moves the second travelling rail 18, and thus the third support beam 32 and its conductor element 48, parallel with itself and also moves the carriage 20 so that the second support beam 27 and its conductor element 47 are moved along their axes.

The prior retraction of the contact points 51 saves wear. After adjustment of the loop size, the pneumatic rams 46 are reverse actuated so that the contact points are pressed firmly against the cyclically next conductor element to ensure good electrical connection.

In a preferred manner of operation, the rams 46 are actuated to separate the loop conductors prior to removal of the finished panel. This is done even during the production of a series of panels of the same size to reduce the risk of damage to the panels and the conductors during removal of one finished panel and positioning of the next panel-forming glazing assembly. The rams 46 are of course reverse actuated prior to bonding of the next successive panel.

Because the fourth support beam 35 (FIG. 1) is fixed, the corner between a conductor element 50 carried thereby (FIG. 4) and the cyclically next conductor element 44 occupies a fixed position to provide a convenient datum point for locating a corner of a glazing assembly which is to be bonded together.

A detail of an example of such a glazing assembly is shown in FIG. 3 and comprises two sheets of glass 52, 53 having metallised and solder coated margins between which is located a spacer element 54 also solder coated. The glazing assembly is carried by a support 55 and is held in position by clamps such as 56 carried by the support beams such as 21 at a level such that the conductor elements of the loop are symmetrically disposed with respect to the spacer element 54.

It is preferred for the panel support 55 to be vertically movable so that panel assemblies may be positioned on that support below the level of the loop and so that bonded panels may be removed at that lower level. Upward travel of the support 55 can be limited to ensure that a glazing assembly carried thereby is located at the correct level for bonding.

Figure 6:
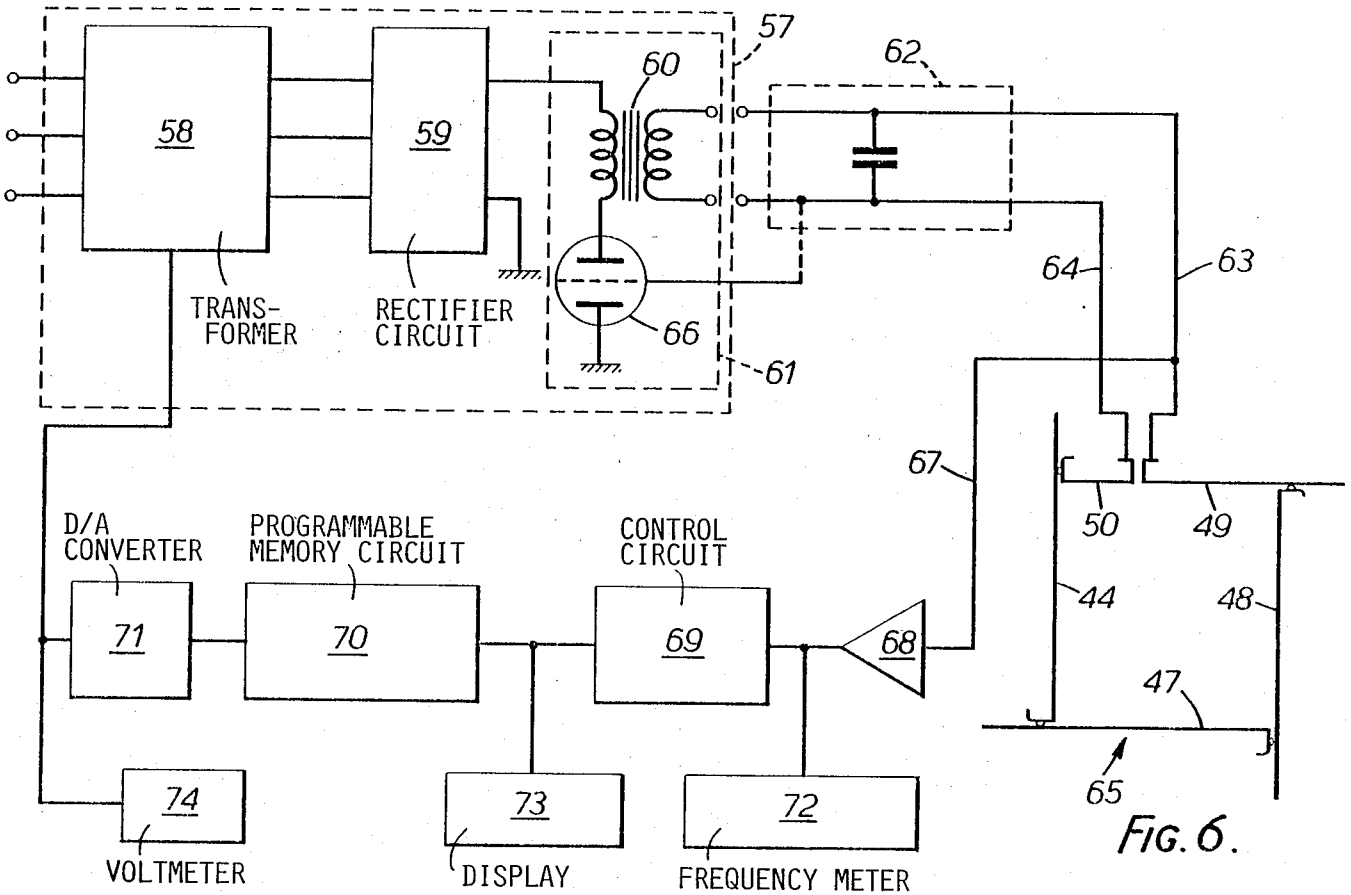
FIG. 6 is a block circuit diagram illustrating current supply to the inductor loop and its control.

The inductor loop is powered by the circuit illustrated in FIG. 6.

Mains current is supplied to an aperiodic generator generally indicated at 57 and comprising a thyristor controlled high tension transformer 58 and a high tension rectifier circuit 59 whence power is supplied to an aperiodic transformer 60 of an oscillator circuit 61. High frequency pulses from the aperiodic transformer 60 are passed via an adaptor circuit 62 to leads 63, 64 and thence to conductor elements 49, 50 of the inductor loop here indicated at 65.

Grid control of triode 66 of the oscillator circuit 61 is effected in known manner by feedback from the adaptor circuit 62, for example using a Heurtey type circuit. In this manner, the adaptor circuit 62 may be located close to the inductor loop 65 and some distance away from the aperiodic generator 57.

Oscillations in lead 63 are monitored via lead 67 and amplifier 68 by a control circuit 69 which passes appropriate signals to a programmable memory circuit 70 and thence to digital/analogue converter 71 which in turn passes a control signal to the thyristor control of the high tension transformer 58 so that the power output of the latter is controlled in dependence upon the resonant oscillating frequency of the whole. A frequency meter 72, a memory address register display 73 and a control signal voltmeter 74 are provided for monitoring procedure.

Figure 7:
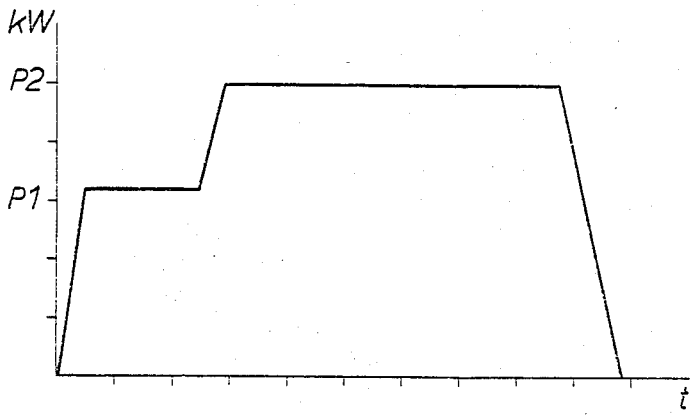
FIG. 7 is a graph illustrating a particular power supply schedule.

In operation, the inductor loop 65 is adjusted for size as necessary and the glazing assembly to be bonded is placed in position. The generator is then switched on at minimum power (P1 in FIG. 7) so that the resonant frequency of the circuit as determined by the load can stabilise and be monitored by the control circuit 69 (in FIG. 6). The control circuit 69 passes a signal to an address appropriate to that frequency in the memory address register 70 whence a signal appropriate to the optimum generator power output at that frequency is passed via the digital/analogue converter 71 to the thyristor control 58 to step up the generator output to the required level (P2 in FIG. 7) which is maintained for the required bonding time.

For optimum bonding, a number of factors govern the oscillation frequency and power output. These include:

1. Required bonding time,
2. Cross-sectional dimensions of loop conductors.
3. Type and dimensions of bonding medium and conductive material leading along the joints to be formed.
4. Joint-loop spacing.
5. Perimeter of panel and loop.

In a particular production line, it is desired to have a total heating time of 8.8 seconds to synchronise with the remainder of the line. The loop conductors are rectangular copper tubes 8 mm high and 12 mm wide with a 1 mm wall thickness. It is desired to manufacture double glazing panels having a 12 mm inter-sheet space using solder-coated, copper, channel-form spacer members located at the edge of the panels as shown in FIG. 3. The inner edges of the loop conductors follow a course spaced from 3 to 5 mm from the edges of the panel sheets and the conductors are located symmetrically of the channel form spacer members. It is desired to manufacture panels of various sizes.

Under these circumstances, the resonant frequency of the system can be related to the perimeter of the panel. This is shown by the lower curve in FIG. 8. The lower half of the ordinate is marked to correspond with the perimeter of the panel to give resonant frequencies increasing along the abscissa.

For each resonant frequency there is an optimum power output determined by the control signal to be passed to the thyristor bridge of the aperiodic generator and this must be determined by experiment.

Figure 8:
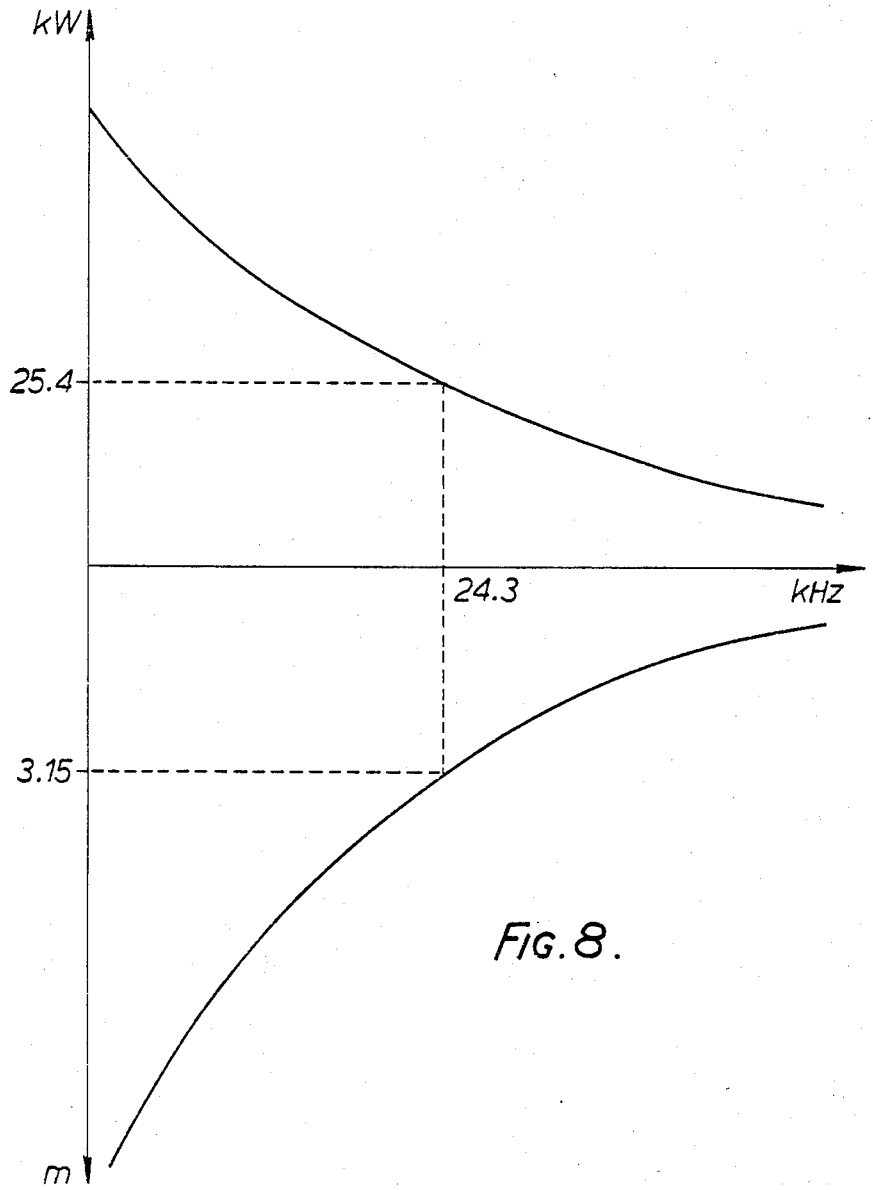
FIG. 8 is a graph illustrating relationships between panel perimeter, resonant frequency and generator power output for optimum bonding of a particular type of panel in a particular apparatus.

Optimum power outputs for bonding under the circumstances outlined above are indicated in the upper curve of FIG. 8. Control voltage values corresponding to these power outputs are programmed into various addresses in the memory register 70. Very good control can be given when voltage values corresponding to 100 Hz increments in resonance frequency are so programmed.

By way of specific example, if it is desired to bond together a panel of the type described above which measures 835×740 mm, giving a periphery of 3.15 m, the size of the inductor loop is adjusted as described if this should be necessary and the panel is positioned within it. The generator is then switched on at low power (P1 in FIG. 7). In this particular example, the aperiodic generator used was manufactured by Masser of Brussels. The minimum stable power output was 16 KW and this was reached about 0.5 seconds after switching on. During the following 2 seconds the oscillating current was allowed to stabilise and its resonant frequency was found to be 24.3 KHz as expected. This frequency was displayed on the frequency meter 72 and passed to the control circuit 69 which then selected the corresponding memory address in memory register 70 as displayed in address register display 73. The appropriate signal was then passed to the digital/analogue converter 71 to cause it to emit a control voltage (displayed by voltmeter 74) to regulate the thyristor bridge circuit 58 to increase the generator power output to the optimum value of 25.4 KW (P2 in FIG. 7). Some 8.8 seconds after switching on, the generator was switched off and the oscillating current in the inductor loop died away in about one second. The completed panel was then removed and on inspection was found to be well bonded together.

We claim:

1. A method of manufacturing an individual glazing panel composed of two sheets, said method comprising: providing electrically conductive means having a heat-activatable bonding medium between the sheets and around the margin of the individual panel to allow the bonding medium to form a joint which joins the sheets together when the bonding medium is activated in situ by induction heating; disposing an inductor around the individual glazing panel for inductively coupling the inductor to the electrically conductive means of the individual panel so that the inductor and the electrically conductive means together constitute an output load having a characteristic resonant frequency, the inductor being associated with the electrically conductive means for causing the bonding medium to be heated simultaneously at all positions along the margin when electrical power is supplied to the output load; applying power to the output load from a generator which can be set to supply power at a selected level for inducing in the output load an induction heating current at the characteristic resonant frequency; and selecting the level of power supplied by the generator to the load in dependence on the instantaneous characteristic resonant frequency of the output load.

2. A method according to claim 1, wherein said step of determining comprises feeding signals indicative of the resonant frequency to a computer in which is stored information relating to generator output power settings appropriate to different resonant frequencies for at least one particular heating time, and deriving the power output setting automatically by output signals from the computer.

3. A method according to claim 1, wherein said step of determining comprises switching the generator on at a first power output for an initial period during which said resonant frequency is monitored, and then increasing the power output of the generator to a setting appropriate to the monitored resonant frequency.

4. A method according to claim 1, wherein the inductor is at least partly displaceable for varying the work-/inductor spacing, and said method is carried out for the successive manufacture of panels of different sizes with appropriate adjustment of the inductor to suit such different sizes.

5. A method according to claim 1, wherein the inductor is in the form of at least one loop formed by at least one conductor so disposed in relation to the marginal course of the joint that the bonding medium is heated simultaneously at all positions along the margin.

6. A method according to claim 5, wherein the inductor loop is formed by at least one conductor of tubular bar or of rod form.

7. A method according to claim 6, wherein said at least one conductor is of rectangular cross-section.

8. A method according to claim 5, wherein, as viewed perpendicularly to the plane of the loop, the path of the loop is at a substantially uniform spacing from the course of the joint.

9. A method according to claim 5, wherein the gap between the joint and the at least one conductor at all points along the course of the joint is less than the height, measured parallel to the thickness dimension of the panel, of the at least one conductor composing said loop.

10. A method according to claim 5, wherein the gap between the joint to be formed and the at least one conductor of the loop at all points along the course of the joint is less than 30 mm.

11. A method according to claim 1, wherein the electrically conductive means forms a continuous conductive path around the margin of the panel.

12. A method according to claim 5, wherein two sheets are simultaneously joined to inter-sheet spacing means disposed along the margin of the panel by a single induction heating effecting step in which the inductor loop is arranged so that the plane of the loop is located substantially symmetrically between the two sheets.

13. A method according to claim 12, wherein the loop is composed of at least one conductor whose dimension, measured parallel to the thickness dimension of the panel, is less than the inter-sheet spacing between said two sheets.

14. A method according to claim 1, wherein said bonding medium is solder.

15. A method according to claim 14, wherein said solder is present as a preformed coating on metallised margins of two glass sheets assembled with at least one intervening metal spacer strip for forming a hollow glazing unit.

16. Induction heating apparatus suitable for induction heating heat-activatable bonding medium associated with electrically conductive means present along the margin of an individual assembly of facing sheets to cause the sheets to be bonded together, said apparatus comprising a circuit composed of a generator for supplying power and an inductor connected to be supplied with power by the generator, the inductor being arranged to be inductively coupled to, and form an output load with, the electrically conductive means, and means connected for automatically controlling the power supplied by said generator to said inductor in dependence on the instantaneous resonant frequency of the circuit when said inductor is inductively coupled to the electrically conductive means.

17. Induction heating apparatus according to claim 16, further comprising a computer in which is stored information relating to generator output power settings appropriate to different resonant frequencies for a particular heating time or for different heating times, and said computer is connected to said circuit and to said generator for automatically regulating the power output of said generator.

18. Induction heating apparatus according to claim 16, wherein said inductor is in the form of a loop within which the panel can be located so that the path of the loop surrounds the periphery of the panel.

19. Induction heating apparatus according to claim 18, wherein said loop is of polygonal shape and comprises straight conductors forming the sides of the polygon.

20. Induction heating apparatus according to claim 18, wherein the size of said loop is adjustable.

21. Induction heating apparatus according to claim 20, wherein at least some of said loop conductors are held in electrical contact with each other releasably or displaceably to permit the size of the loop to be varied.

22. Induction heating apparatus according to claim 19, wherein each side of the polygon is formed of at least one conductor, and said conductors forming adjacent sides of the polygon are movable in a direction oblique to themselves whereby the at least one conductor of each side is movable into or out of contact with the conductors of both adjacent sides of the polygon.

23. Induction heating apparatus according to claim 20, wherein the loop has a plurality of sides and at least one side of the inductor loop is bodily movable parallel with itself and relative to one or more other sides of the loop.

24. Induction heating apparatus according to claim 20, wherein the loop has a plurality of sides and at least one side of the inductor loop is carried by a guided displaceable beam.

25. Induction heating apparatus according to claim 18, wherein said loop is formed by tubular bar conductors of rectangular section.

26. A glazing panel manufactured by a method according to claim 1.

* * * * *